US008166881B2

(12) United States Patent
Dietrich et al.

(10) Patent No.: US 8,166,881 B2
(45) Date of Patent: May 1, 2012

(54) REMOTE SETTING FOR ELECTRONIC SYSTEMS IN A PROJECTILE FOR CHAMBERED AMMUNITION

(76) Inventors: Stephan Dietrich, Verdun (CA); Roger Galinas, Repentigny (CA)

( * ) Notice: Subject to any disclaimer, the term of this patent is extended or adjusted under 35 U.S.C. 154(b) by 0 days.

(21) Appl. No.: 13/219,241

(22) Filed: Aug. 26, 2011

(65) Prior Publication Data

US 2012/0012023 A1 Jan. 19, 2012

Related U.S. Application Data

(62) Division of application No. 12/278,832, filed on Dec. 17, 2008, now Pat. No. 8,042,470.

(51) Int. Cl.
*F42C 17/04* (2006.01)
*F42C 19/00* (2006.01)

(52) U.S. Cl. ..... 102/439; 102/215; 89/6.5

(58) Field of Classification Search ..... 102/200, 102/202, 206, 215, 265, 270, 439; 89/6, 89/6.5

See application file for complete search history.

(56) References Cited

U.S. PATENT DOCUMENTS

| | | | | |
|---|---|---|---|---|
| 3,814,017 | A * | 6/1974 | Backstein et al. | 102/215 |
| 4,015,531 | A * | 4/1977 | Ziemba | 102/206 |
| 5,078,051 | A * | 1/1992 | Amundson | 102/206 |
| 5,097,765 | A * | 3/1992 | Ziemba | 102/218 |
| 5,147,973 | A * | 9/1992 | Ziemba | 102/214 |
| 6,202,532 | B1 * | 3/2001 | Kadushin | 89/6.5 |
| 6,526,892 | B2 * | 3/2003 | Heitmann et al. | 102/472 |
| 6,725,781 | B2 * | 4/2004 | Niemeyer et al. | 102/472 |
| 8,042,470 | B2 * | 10/2011 | Dietrich et al. | 102/215 |
| 2008/0006169 | A1 * | 1/2008 | Geswender | 102/430 |

* cited by examiner

*Primary Examiner* — James Bergin
(74) *Attorney, Agent, or Firm* — Harvey S. Kauget; Phelps Dunbar LLP

(57) ABSTRACT

A fuze setting circuit in an artillery or tank shell having a case with a press-fitted head assembly is provided with an electro-mechanical fuze-wiring link that is completed electrically by mechanical assembly of a tracer-carrying projectile on the shell casing, and by the rotational attachment of a programmable fuze onto the projectile.

8 Claims, 15 Drawing Sheets

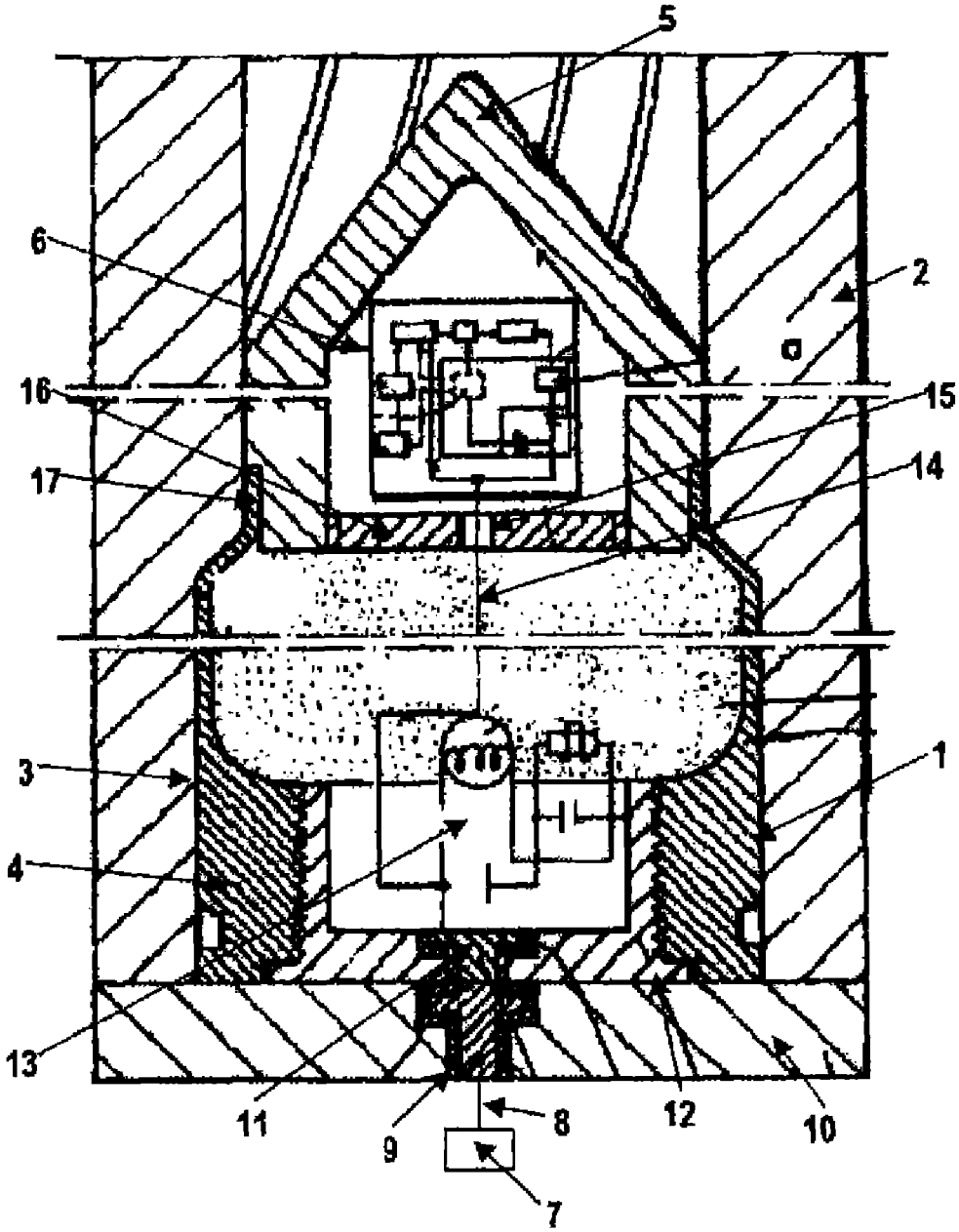
FIGURE 1 - PRIOR ART

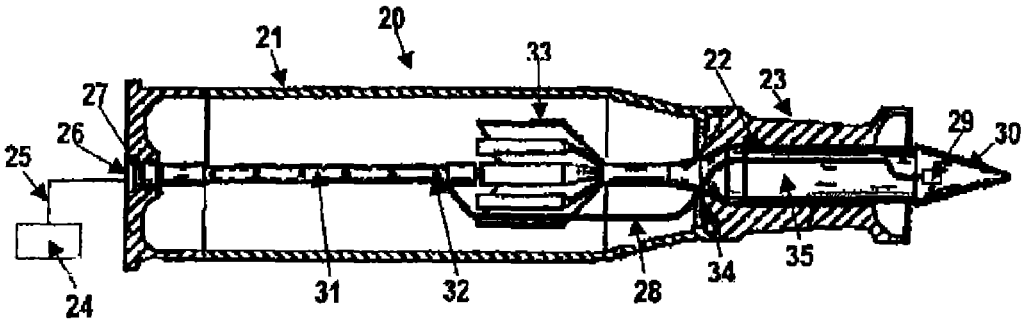
FIGURE 2 - PRIOR ART
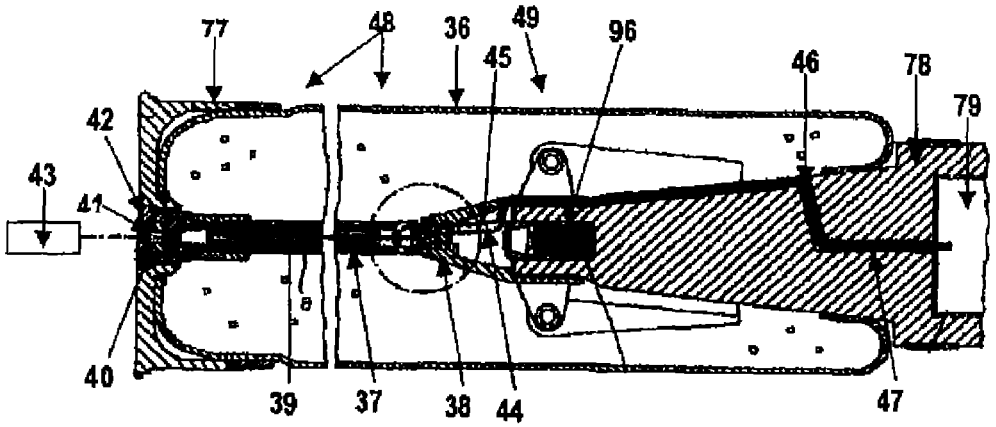
FIGURE 3 - PRIOR ART

REMOTE SETTING FOR ELECTRONIC SYSTEMS IN A PROJECTILE FOR CHAMBERED AMMUNITION

CROSS REFERENCES TO RELATED APPLICATIONS

This application is a divisional of commonly owned U.S. Utility patent application Ser. No. 12/278,832, filed Dec. 17, 2008 now U.S. Pat. No. 8,042,470, entitled: REMOTE SETTING FOR ELECTRONIC SYSTEMS IN A PROJECTILE FOR CHAMBERED AMMUNITION, this Utility patent application incorporated by reference herein.

FIELD OF THE INVENTION

This invention relates to the field of medium and large-calibre tank and artillery ammunition and provisions for a capability of remotely programming such ammunition in one of several predefined modes immediately prior to firing. In particular, it relates to the electromechanical configuration of the circuitry required when incorporating a multi-functional electronic fuze or other type of trigger mechanism into the projectile of a multipurpose, large-calibre high-explosive or other pay-load carrying cartridge

BACKGROUND OF THE INVENTION

It is now customary to provide circuitry that allows the fire control system of a gun to remotely select the fuze operating mode as, for example, either point detonation, or point detonation delay, or air burst through the use of a timing or turn-counter device, or proximity operating modes, or any combination thereof, after the ammunition is loaded into the gun and before it is fired.

Although the invention described herein is generally applicable to medium-calibre and large-calibre tank and artillery guns, the specific application cited will be that for the 105 mm tank gun. Further, although the invention is described in respect to setting a fuze, the invention could also be used to activate a trigger for programming a camera, activating a chemical sensor, turning-on a target designator-illuminator or actuating other similar types of payload.

Currently there are two general types of ammunition carried by tanks with 105 mm guns: (1) those containing armour piercing, fin stabilized, discarding sabot (APFSDS) projectiles: and (2) those containing a high explosive (HE) fill. The former is a kinetic energy penetrator that is effective against tanks or other "hard" targets, whereas the latter's explosive fill detonates upon impact against such targets as field fortifications, light vehicles, light structures, and personnel. The separate formats of this current technology reduce flexibility and severely limit the types of targets that a tank can effectively engage rapidly.

This lack of flexibility also makes tanks vulnerable to attack from, for example, an infantryman armed with a shoulder-fired rocket-propelled grenade (RPG) launcher, if they are loaded with APFSDS cartridges. In this scenario, the tank commander would want to bring anti-personnel fire to bear as quickly as possible in the form of an air-burst projectile near the attacker to eliminate the threat to his vehicle. This is not possible with the limited choice of discrete ammunition now available for tanks carrying 105 mm guns. The same situation would apply should such a tank come under sudden air attack from a helicopter. Without an air burst capability at its disposal, defence against such an attack is compromised, nor can effective offensive action be taken against "soft" targets such as helicopters, light aircraft or lightly protected personnel.

A solution to this dilemma is to have a third type of 105 mm cartridge, one with a multipurpose capability added to the mix of cartridges carried in tanks such as the Leopard Main Battle Tank. The projectile for such a cartridge would contain an explosive charge and a multi-option fuze that is governed by a suitable fire control system (FCS) that instantaneously and remotely selects the required fuze setting of a chambered round in response to a perceived threat. Options for the fuze would include, for example, point detonation (PD), point detonation delay (PDD), proximity airburst, and timed airburst. Changes to the setting of the fuze could be made up to the moment the projectile is fired. Once accepted into the inventory, this multipurpose high-explosive projectile (MPHE) could, in most instances, replace the current HE rounds, thereby enhancing both the offensive and defensive capabilities of the tank while maintaining just two natures of ammunition on board.

Since the multi-option fuze in a MPHE projectile is to be remotely programmable by the Fire Control System when the cartridge is chambered, it must be electronic in nature. One way to achieve this is to provide a gun chamber with a specific hard-wired electrical circuit connecting the FCS to the electronic fuze. However, the existence of large numbers of 105 mm tank guns in the inventories of many armies makes it impractical to require burdensome modifications to all of them for new, hard wired circuitry. Thus, it is imperative that no modifications be made to the tank guns that will fire MPHE cartridges.

There are several ways to effect hard wiring between the FCS and the fuze. These include making the electrical contact between the FCS and the cartridge through: (1) the side of the projectile; (2) the side of the case; (3) the base of the case; (4) the primer via the firing pin; or (5) an insulated sheath containing a conductive layer. If there are to be no modifications to the tank gun, it is most practical to utilize the existing firing pin as the interface with the chambered cartridge (i.e., through direct contact with the cartridge primer). Under these circumstances, both the electrical fuze-setting signal and the electrical firing impulse enter the cartridge through a common electrical contact.

It is, therefore, imperative that the design of the fuze-setting circuit inside the cartridge be capable of carrying the setting signal to the fuze, which can be located in either the base or in the nose of the projectile, at any time up to the moment of firing without prematurely igniting the propelling charge. Such premature ignition is normally avoided by the inclusion of one or more blocking diodes, plus the fact that different signal levels are used for fuze setting and firing.

Technology to achieve this is well known and described abundantly in the prior art going back at least as far as U.S. Pat. No. 3,814,017 (now expired).

This prior art also describes a variety of novel solutions for the electromechanical circuitry to physically achieve the remote programming of a chambered cartridge prior to firing (e.g., the placement of conductors, the type of conductors, the contacts between various parts of the circuit). Each of these solutions depends on the physical design of the gun/ammunition system under consideration. Common to all solutions, however, is the requirement for reliable circuitry from the base of the case through the length of the case to the projectile, and then onwards to the nose of the projectile where the multi-option fuze is usually located. The range of solutions in the prior art is illustrated in the six patents discussed in the following paragraphs.

U.S. Pat. No. 3,814,017 shows a design with a similar intent to that of the invention. Specifically, it describes a "method and system arrangement for determining the type and condition of ammunition which is ready for firing and can be detonated electrically . . . ". This patent, however, which has now expired, does not give details as to how the various circuits are physically located inside the cartridge. It only shows a wire running from the base of the ignition primer through the middle of the propellant charge before directly entering the projectile through a large undefined aperture, which does not appear to separate the propellant from the projectile in an airtight manner. There is no tracer in the projectile and little detail of the various electrical connections is provided beyond the written description that they are "plug contacts". The present invention concentrates on a specific method, different from and more detailed than that described in U.S. Pat. No. 3,814,017, for installing the circuitry in the cartridge.

U.S. Pat. No. 4,015,531, which has also expired, describes a system wherein the gun voltage for initiating the primer of a round of ammunition having a fuzed warhead is used to "contemporaneously charge the power supply capacitor of the warhead". Although this patent is primarily directed towards high rate-of-fire cannons in airplanes, the general method for transmitting the signal to the capacitor in the projectile is similar to that of U.S. Pat. No. 3,814,017 detailed in the previous paragraph. Again, the present invention concentrates on the method of constructing the circuitry, which is different from the method described in U.S. Pat. No. 4,015,531 and resolves problems encountered in the larger cartridges associated with tank guns.

U.S. Pat. No. 5,078,051 is directed "to an improved electrical communication system which facilitates the transmission of pre-launch communication from the firing mission computer to update the program of the round", including the projectile control system. Its cartridge is similar to that in the present invention in that it contains a primer flash tube for ignition of the propelling charge through which a conductor in the form of a wire passes before exiting near the base of the projectile and continuing outside the projectile before reentering it in an undetermined way. This part of the circuit in the present invention is entirely contained inside the length of the 105 mm projectile, after entering it through a different path which is one feature of the invention.

U.S. Pat. No. 5,097,765 describes a remotely set digital time base fuze in a cartridge case where fuze power, time setting information and cartridge firing are performed sequentially over the same hardwire line through the electric primer terminal. In particular, the digital time fuze is adjacent to the base of the projectile.

U.S. Pat. No. 5,147,973 follows on from U.S. Pat. No. 5,097,765 referenced above. It, too, describes a multi-functional fuze system with overall performance objects similar to those described in the present invention. In this instance there are two fuzes, one of which is essentially identical to that described in U.S. Pat. No. 5,097,765 while the other is an independently powered proximity fuze located in the nose of the projectile.

U.S. Pat. No. 6,526,892 describes a hard-wired, remotely programmable fuze system for tank ammunition, but it necessitates modifications to the tank gun. The electrical connection with the tank in this design is through the base of the cartridge case, but it requires a connecting pin and associated circuitry as new, additional components to the gun (i.e., existing guns would have to be modified to fire the cartridge of U.S. Pat. No. 6,526,892). In this design, entry of the circuit into the projectile is at its base, but not through the tracer. Further refinements to this design are found in US Patent Application Publication 2004/0003746 A1 (8 Jan. 2004).

Details of Prior Art Electromechanical Circuits

To establish differentiation of the invention from the prior art, it is first necessary to take a closer look at three of the inventions mentioned in Section I above. FIGS. 1, 2 and 3 show the prior art configurations for the remote programming of a nose fuze in a large calibre shell for firing from, for example, a tank. They correspond, respectively, to U.S. Pat. Nos. 3,814,017, 5,078,051 and 6,526,892. These patents illustrate three different circuit configurations for transmitting the desired signals from a remote fire control system to a programmable fuze located in the nose of a chambered high explosive ammunition round.

In FIG. 1 (prior art U.S. Pat. No. 3,814,017) chamber I of large calibre barrel 2 contains shell 3 comprising cartridge case 4 and high explosive projectile 5 which contains fuze 6. Fire control system 7 is hard wired to shell 3 via conductor 8, which is connected to shell 3 through contact 9 (in breech block 10) and contact 11 (in electrical ignition primer 12). Signals from the fire control system destined for fuze 6 are prevented from entering the circuitry 13, associated with electrical ignition primer 12, by directing diodes, thereby bypassing said circuitry 13 and going onward to fuze 6 via conductor 14 and aperture 15 through the base 16 of projectile 5. The circuit is completed through the metal portion of projectile body 5 and the metal cartridge case 4, which are attached at joint 17.

In FIG. 2 (prior art U.S. Pat. No. 5,078,051) large calibre cartridge 20 comprises case 21 and fin stabilized high explosive projectile 22 contained in discarding sabot 23. Fire control box 24 is hard wired to cartridge 20 via conductor 25 and conductive ignition electrode 26, which is contained in primer housing 27. Transmission line 28 connects conductive ignition electrode 26 with fuze electronics package 29 contained in nose cone 30 of projectile 22. En route to electronics package 29, transmission line 28 first passes through the interior of primer flash tube 31 before exiting through one of the holes 32 at its forward end to bypass fins 33 of projectile 22. Transmission line 28 next enters projectile 22 in an undefined way at the tapered rear end 34 of that portion of projectile 22 that contains explosive charge 35 and then continues on through said explosive charge 35 until it reaches electronics package 29 in nose cone 30. Transmission line 28 contains the necessary conductors to transmit signals from fire control box 24 to electronics package 29 in a fully self-contained manner (i.e., it does not require the case 21 or projectile 22 or discarding sabot 23 to be part of the circuit). As in prior art U.S. Pat. No. 3,814,017 described above, signals destined for electronics package 29 are prevented from entering circuitry (not shown) located near conductive ignition electrode 26 that is reserved for the electrical ignition of primer flash tube 31.

In FIG. 3 (prior art U.S. Pat. No. 6,526,892) large calibre cartridge 49 comprises case 48 and projectile 78 accommodating tracer unit 96 and programmable projectile fuze 79. The case 48 is made up of two parts, base 77 and combustible jacket 36. Primer flash tube 37 is connected with base 77 and has an intricately designed contact plug 38 at its forward end. Contact plug 38 receives cable 39 after said cable 39 passes through primer flash tube 37, having entered cartridge 49 through annular aperture 40 of base 77. Aperture 40 is sufficiently offset from the centre of base 77 so that cable 39 is independent of primer electrode 41 (i.e., the electrical ignition circuit (not shown) and the circuit to program fuze 79 are completely different and separate); the ground for cable 39 is provided by the container 42 that holds electrode 41. Cable 39 is, therefore, effectively wired to fire control system 43, which remotely programs fuze 79. Timing cables 44 and 45 emanate from contact plug 38 and pass up the outside of the rearward end of projectile 78 so as to avoid tracer unit 96. They enter projectile 78 at aperture 46 and proceed through conduit 47 to programmable fuze 79. This design was subsequently refined as described in US Patent Application Publication 200410003746 A1 (8 Jan. 2004).

The invention described herein as follows includes features in the design of an electromechanical circuit that significantly differentiates it from the prior art described above. The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention features an electromechanical circuit that transmits electrical setting signals from the fire control system of, for example, a tank in one application, to a programmable fuze situated in the high explosive projectile of a fully-chambered cartridge in a medium or large-calibre gun. One aspect of the invention is to provide a reliable electromechanical circuit for the transmission of the setting signal that is both easier, from a production point of view, and more economical to install in contrast to the transmitting circuits described by the prior art.

According to various aspects of the invention, the electromechanical circuit contains up to five contacts or interfaces, each of which contains original features in its design. The first of these, known as the head assembly contact, contains two diodes: one to ensure that the setting signal for the fuze does not ignite the propellant in the case; and the other to isolate the fuze from the firing signal. Since the head assembly contains several pieces (electrode, bridge wire, primer or detonator equivalent, relay charges, metal diode holders, insulators, etc.), the configuration of these parts is pertinent to the ease that they can be assembled and the resulting reliability and safety demanded by the separation of the setting signal from the firing signal. To this end, one novel feature of the head assembly contact eliminates the soldering of electrical connections from the assembly procedure and replaces this operation by simple press fitting of the parts together. This also helps preserve the insulating integrity of the press-fitted surfaces. Another feature involves the placement of the diodes and diode holders such that the conductors leading to subsequent portions of the circuit can be readily attached thereto. One aspect of the invention, therefore, is the provision of a simple, reliable, easily manufactured and readily installed head assembly contact integrally containing a portion of the faze signal-setting circuit including one or more diodes having accessible electrical connections to the remainder of the circuit.

The second and third contacts in the fuze-setting circuit, known respectively as the rear tracer contact and the forward tracer contact, are unique in that they utilize the electrically-conductive (usually metallic) container of the tracer unit to transmit the setting signal. While reference is made to a tracer unit, the same structure may apply in the case of a baseburner or other rocket motor system. Further, the electrically-conductive container may be empty. This feature of the invention has the advantage of simplifying the assembly of the projectile into the casing, automatically establishing the electromechanical fuze-setting circuit connection at the base of the projectile and facilitating its entry into the interior of the projectile at this position. In both instances a simplified series of mechanical parts, both conducting and non-conducting and including a spring-loaded connector, that are easy to manufacture and assemble make up the design. Thus, a further aspect of the invention is the inclusion of the tracer unit, specifically the electrically-conductive tracer container, in the electromechanical setting circuit for the fuze.

The forward tracer contact is also characterized by an electrical connection made through at least one novel high-pressure seal to ensure against the possibility of hot propellant gases reaching the explosive charge in the projectile and causing premature detonation. Such seals may be made of anodized aluminum or other suitable insulating materials, which not only provide the necessary strength but also allow electrical current to be transmitted only longitudinally (i.e., not transversely to surrounding media). These seals (one or more) are so arranged as to form part of the electromechanical setting-signal circuit. An additional aspect of the invention, therefore, is the inclusion of high-pressure seals in the electromechanical setting circuit for the fuze.

The fourth contact, located at the nose of the projectile case and known as the fuze contact, uses a spring-loaded connector to ensure a positive interface with the base of the fuze. It is effected by an annular ring of a conducting material on the base of the fuze. With this design, the fuze contact will transmit the setting signal to the fuze regardless of the rotational orientation of the fuze when it is assembled into the fuze/booster cavity, normally by screwing. Another aspect of the invention, therefore, is the formation of the projectile body/fuze electrical interface in the electromechanical circuit through the use of a spring-loaded connector in combination with a 360° conducting ring on the fuze body itself. This form of electrical connection is not limited to the environment of a programmable shell, but may be applied wherever an electrical contact must be made in conjunction with a threaded mechanical coupling.

This simplified rear tracer contact provides yet another aspect of the invention by utilizing the tracer container as an integral part of the fuze setting-signal circuit, thereby permitting a unique "plug-in" method of final cartridge assembly that is safe, cost effective and fully reliable. It is achieved following two preassemblies:

(1) Case preassembly, comprising principally the cartridge case loaded with propellant, primer flash tube with end closure, head assembly contact, rear tracer contact with spring loaded connector, and a guide tube/funnel; and (2) Projectile preassembly, comprising principally the projectile loaded with high explosive, fuze, fuze contact, and tracer unit with electrically-conductive tracer container.

The final assembly of the cartridge then consists of simply inserting the projectile preassembly into the case preassembly with the tracer unit being guided into place by the guide tube/funnel. After the rear end of the tracer container of the projectile preassembly comes into contact with the spring-loaded electrical connector of the case preassembly, no further adjustment is necessary. This user-friendly "plug-in" operation provides simultaneous mechanical and electrical coupling at the case/projectile interface that is fully reliable. Yet another aspect of the invention, therefore, is the creation of a positive setting-signal circuit electrical connection at the interface of the two preassemblies when the rear end of the tracer container, or equivalent, is fitted to the spring-loaded electrical connector in the case preassembly.

The foregoing summarizes the principal features of the invention and some of the optional aspects. The invention may be further understood by the description of the preferred embodiments, in conjunction with the drawings, which now follow.

SUMMARY OF THE FIGURES

FIG. 1 is a cross-sectional view of a prior art large-calibre high explosive tank shell capable of programming its nose fuze from a remote fire control system as described in U.S. Pat. No. 3,814,017.

FIG. 2 is a cross-sectional view of a prior art large-calibre high explosive tank shell capable of programming its nose fuze from a remote fire control system as described in U.S. Pat. No. 5,078,051.

FIG. 3 is a cross-sectional view of a prior art large calibre high-explosive tank shell capable of programming its nose fuze from a remote fire control system as described in U.S. Pat. No. 6,526,892.

FIG. 6D is the same view as FIG. 6A but with an alternate diode placement.

DESCRIPTION OF THE PREFERRED EMBODIMENT

Figure 4:
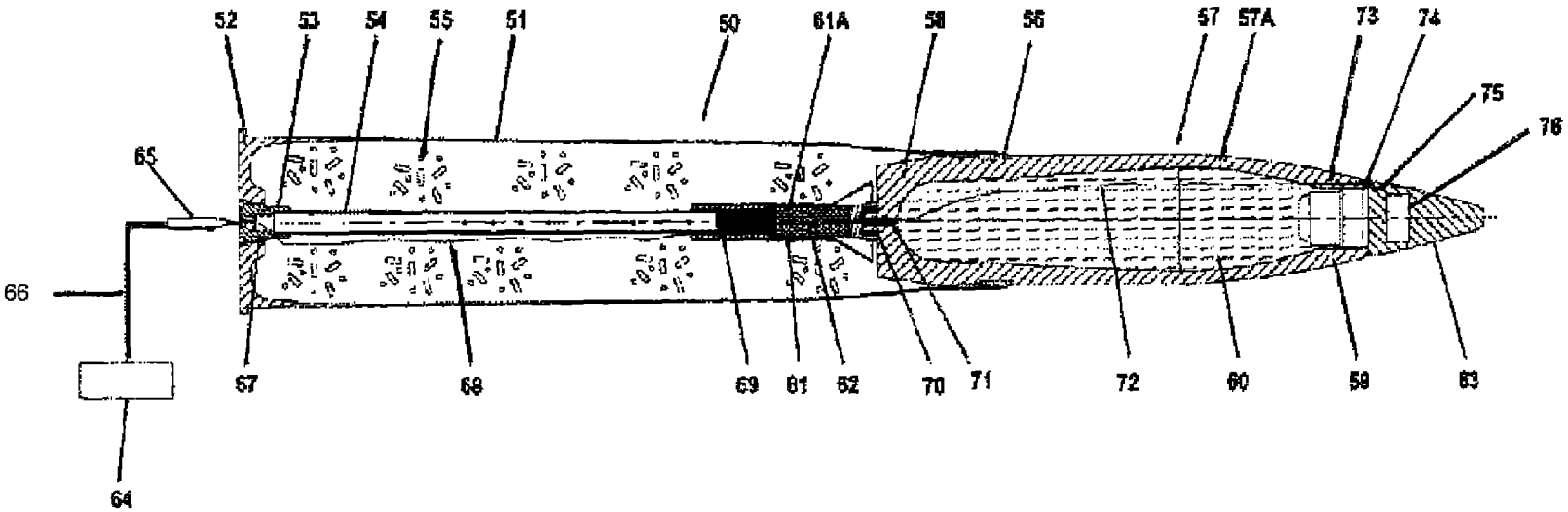
FIG. 4 is cross-sectional side view of a 105 mm high explosive shell illustrating the subject electromechanical circuit connecting the fire control system to the programmable fuze.

In FIG. 4 large calibre cartridge 50 comprises: cartridge case 51 with cartridge case base 52; head assembly contact 67; head assembly holder 53; primer flash tube 54; propellant 55; driving band 56; projectile 57 comprising projectile body 57A, projectile base 58, projectile nose 59 and a load exemplified by high explosive 60 fill; tracer unit 61A with electrically-conductive tracer container 61 containing tracer compound 62; and programmable multi-functional electronic fuze (or fuze) 63 containing fuze electronic circuit 76 as an example of programmable electronics. Fire control system 64 is hardwired to firing pin 65, which is located in the breech (not shown), by conductor 66. Firing pin 65 bears directly on electrode 80 (see FIG. 6A) of head assembly contact 67. Through intermediaries, insulated electrode 80 is eventually connected to conductor 68, which then runs along the outside of primer flash tube 54 to connect with rear tracer contact 69.

The rear tracer contact 69 connects to electrically-conductive tracer container 61 (or base burner container or rocket motor) which, in turn, is connected to forward tracer contact 70 assembly whose forward end passes through conduit 71 in projectile base 58. The terminal end of conduit 71 serves as a seat for a high-pressure seal described further below. Conductor 72 is electrically connected to forward tracer contact 70 assembly and runs through high explosive 60 and conduit 73 in projectile nose 59 to fuze contact 74. Conductor 75 is connected to fuze contact 74 at one end and to fuze electronic circuit 76 of fuze 63 at its other end.

The subject of this invention is the electromechanical circuit that allows signals originating from fire control system 64 to be transmitted to electronic circuit 76 of fuze 63 in a fully reliable and safe manner. The elements that make up this circuit are: firing pin 65, head assembly contact 67, conductor 68, rear tracer contact 69, electrically-conductive tracer container 61, forward tracer contact 70 assembly, conductor 72, fuze contact 74, conductor 75 and fuze electronic circuit 76. The return portion of the circuit may be provided by projectile 57 outer surface, unpainted driving band 56 and/or cartridge case 51, which overlaps with a portion of the driving band 56 and is electrically connected to the head assembly holder 53. Whereas projectile 57, driving band 56 and cartridge case 51 are often metallic in nature, thereby electrically-conductive, they may also be made of other electrically-conductive materials. Where cartridge case 51 is of a non-electrically-conductive material, a dedicated conductor may optionally be provided linking projectile 57 with cartridge case base 52 or reliance may be placed upon gun parts electrically connected through the driving band 56 to provide this electrical link.

Figure 5:
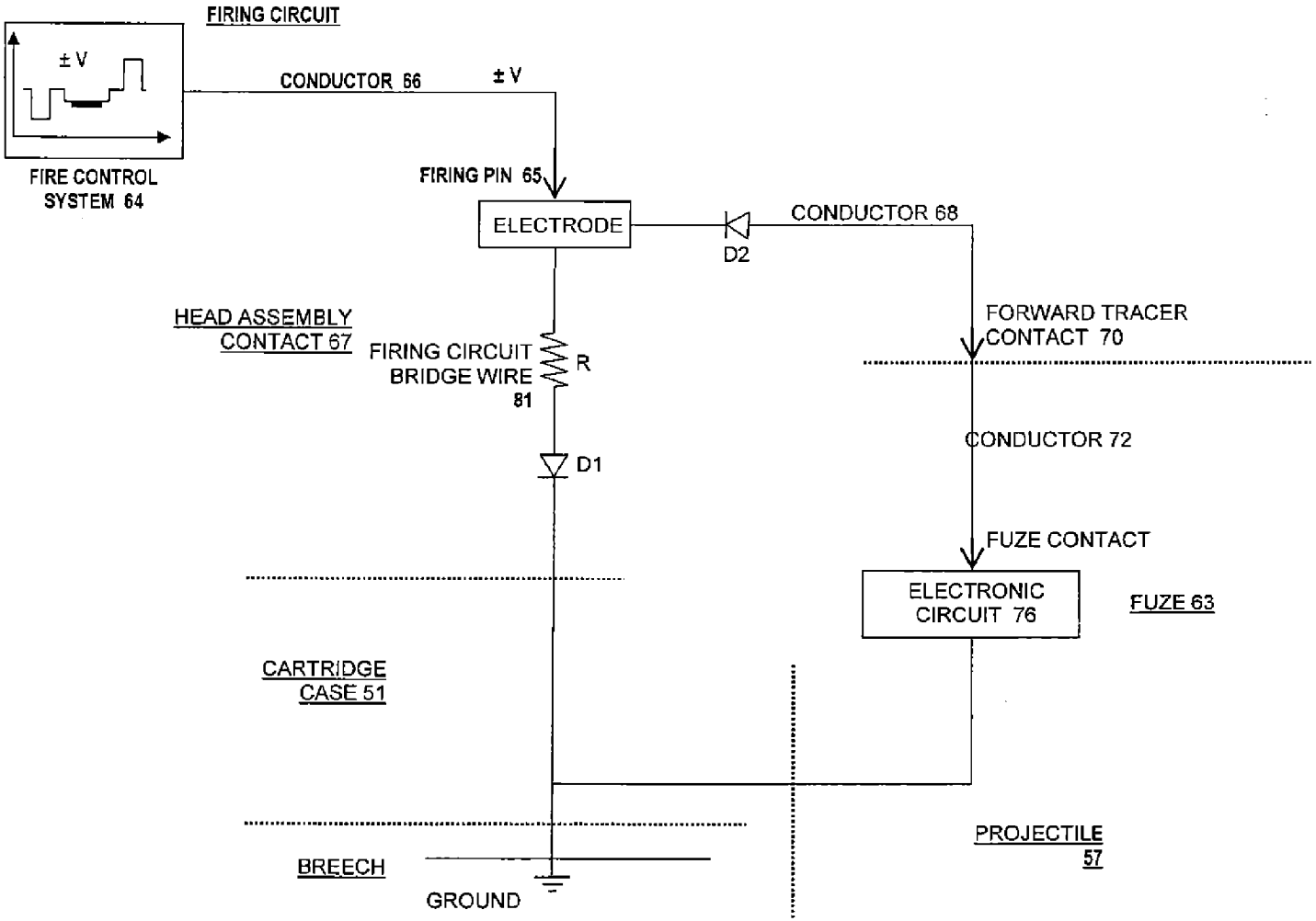
FIG. 5 is a simplified schematic of the electromechanical circuit of FIG. 4 showing its relationship to the firing circuit.
Figure 6A:
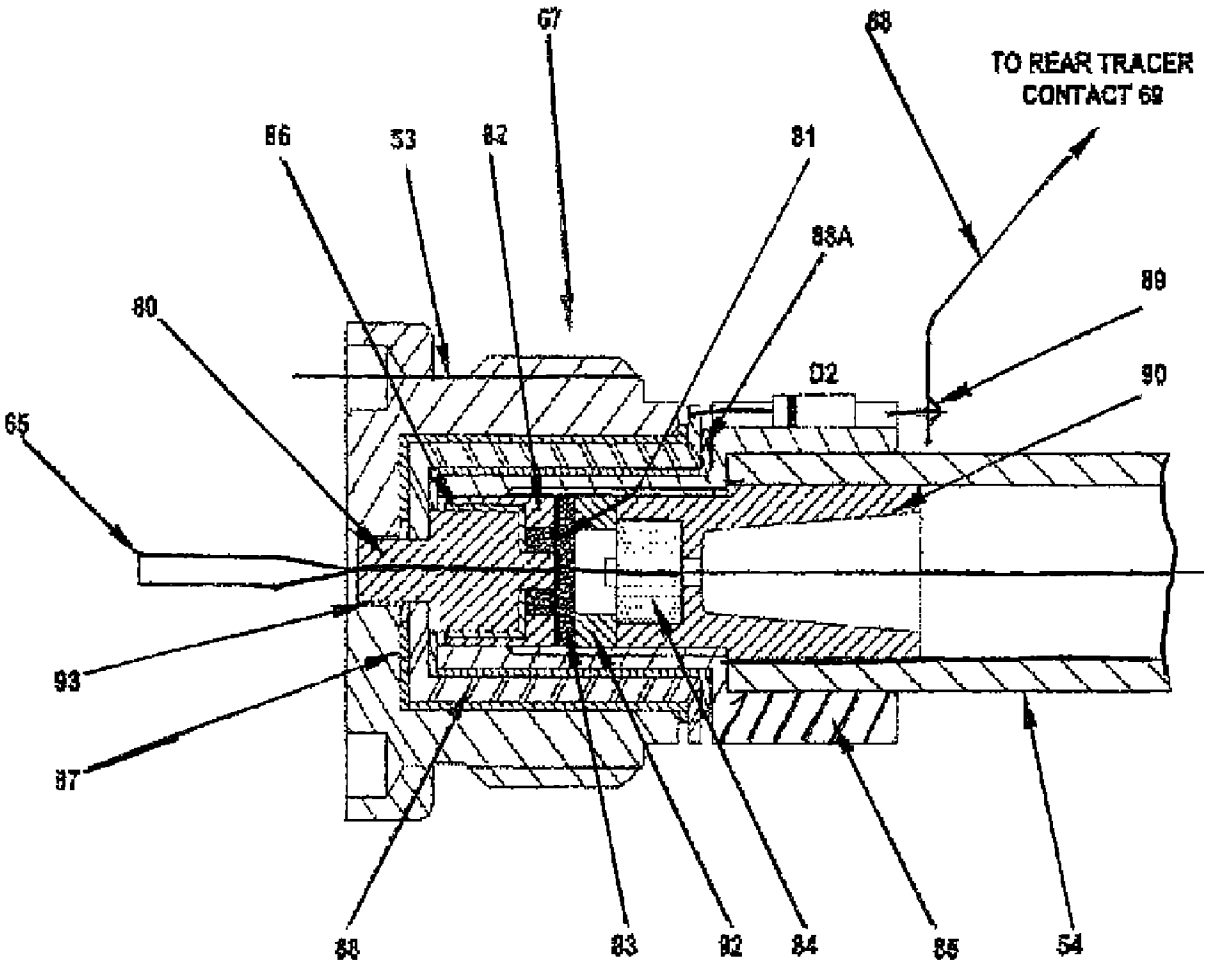
FIG. 6A is a cross-sectional side view of the head assembly contact.

FIG. 5 is a simplified schematic of the electromechanical circuit described above and illustrated in FIG. 4, but also showing the associated bridge wire 81 circuit for igniting propellant 55 (see FIG. 6A for details). The bridge wire 81 is a resistance R which, upon receiving the firing signal, will become sufficiently hot to ignite the primer. As such, the bridge wire 81 constitutes the primer igniter. The bridge wire 81 portion of the circuit is connected in the electronic circuit so that diode D1 prevents the fuze-setting signal, having appropriate polarity, from passing through bridge wire 81; and diode D2 prevents the firing signal, of opposite polarity, from passing through the fuze electronic circuit to the fuze 63.

Thus diode D1 is electrically oriented to isolate bridge wire 81 from the electrical fuze-setting signal, thereby ensuring that this setting signal for the programmable electronic circuit of fuze 76 does not ignite bridge wire 81. And second diode D2 is electrically oriented to isolate fuze electronic circuit 76 during ignition of the propellant 55 from the firing signal. Both diodes DI, D2 are electrically connected to receive setting and firing signals through the electrode 80 of head assembly contact 67.

Although not absolutely necessary, diodes D1 and D2 are present for redundant safety considerations. The difference in energy requirements between the firing circuit and the fuze electronic circuit 76, the former being at least 10 times greater than the latter, means that the setting signal, even if allowed to pass through the bridge wire 81, would not normally ignite it. Nevertheless, the diodes DI and D2 preclude the risk of a premature firing occurring, based on using a first polarity for the setting signal and a second, opposite, polarity for the electrical firing signal.

Figure 6C:
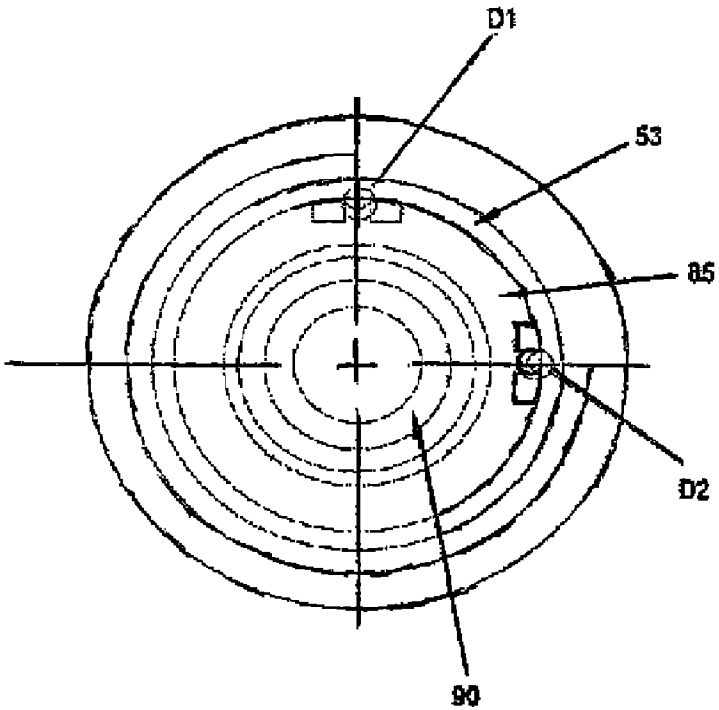
FIG. 6C is an end view of the head assembly contact.
Figure 6B:
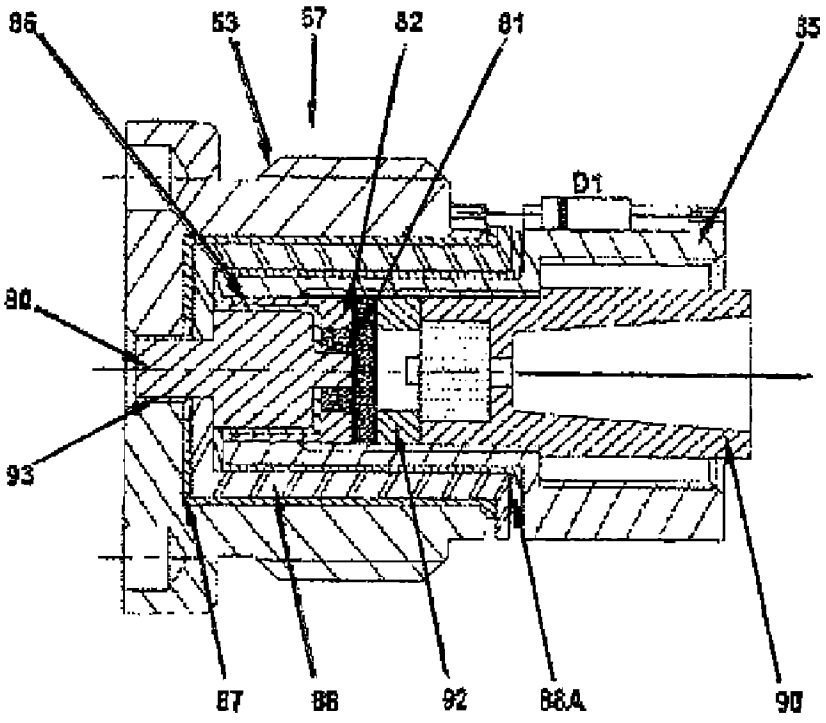
FIG. 6B is the same view as in FIG. 6A except that the head assembly contact has been rotated 90° along its longitudinal axis.
Figure 8D:
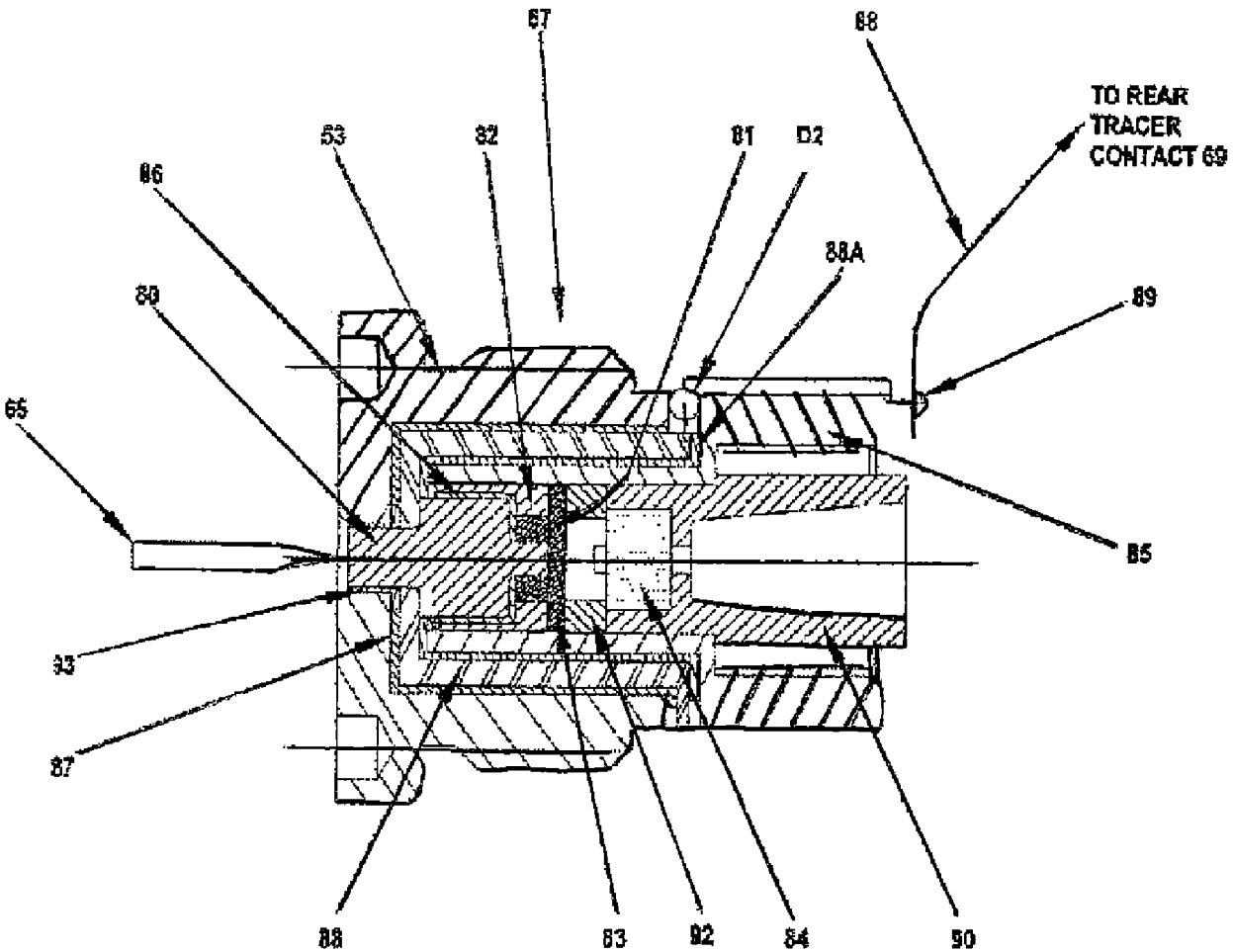
FIG. 8A is a cross-sectional side view of the forward tracer contact within the projectile.
FIG. 8B is an enlarged cross-sectional side view of the insulated electrically-conductive high-pressure seal shown in FIG. 8A.
FIG. 8C is a cross-sectional side view of an alternative design of the forward tracer contact of FIG. 8A.

The head assembly contact 67 includes the head assembly holder 53 for containing head assembly components, as shown in FIGS. 6A, 6B and 6C. FIG. 6B is the same view as shown in FIG. 6A except that it is rotated 90° along its longitudinal axis to illustrate the relative preferred positioning of diodes DI and D2. This is further illustrated in the end view of head assembly contact 67 shown in FIG. 6C.

FIG. 6A details head assembly contact 67, which contains a first electrically-conductive cylindrical sleeve 88 fitted within the head assembly holder 53 for electrical connection to the firing pin 65 contacting electrode 80. This first electrically-conductive cylindrical sleeve 88 is fitted into the head assembly holder 53 as a sliding engagement but separated electrically from the head assembly holder 53 by first sleeve insulation means 87. An electrically non-conductive adhesive may be employed to ensure that the first electrically-conductive cylindrical sleeve 88 is held in place within the head assembly holder 53.

A second electrically-conductive cylindrical sleeve 85 is fitted within the first electrically-conductive cylindrical sleeve 88, again by a sliding engagement, optionally with electrically non-conductive adhesive present. This second electrically-conductive cylindrical sleeve 85 is further isolated electrically from the first electrically-conductive cylindrical sleeve 88 and the head assembly holder 53 by second sleeve insulation means 88A.

Said head assembly contact 67 further contains the ignition cup-sub-assembly 82 consisting of electrode 80 fitted within ignition cup sub-assembly 82 as a sliding engagement but separated electrically by ignition cup insulation means 86. Ignition cup sub-assembly 82 further containing ignition charge 83 and bridge wire 81 is then preferably press-fitted into second electrically-conductive cylindrical sleeve 85 closing (or providing) electrical connection between electrode 80, bridge wire 81, ignition cup sub-assembly 82 and second electrically-conductive cylindrical sleeve 85. Head assembly holder 53 is electrically connected to second electrically-conductive cylinder sleeve 85 with diode DI to complete the firing circuit.

Electrode 80 further makes electrical contact with the first electrically-conductive cylindrical sleeve 88. During assembly, electrode 80 is preferably press-fitted first through a circular hole in the end of first electrically-conductive cylindrical sleeve 88 while being electrically insulated from the head assembly holder 53 by insulation means 93. Retainer 92 is then threaded to second electrically-conductive cylindrical sleeve 85 as an additional means to maintain ignition cup sub-assembly 82 in place.

Said head assembly contact 67 further contains flash tube seat 90 containing relay charge 84, fitted contiguous to retainer 92, and threaded to second electrically-conductive cylindrical sleeve 85. When ignition charge 83 is ignited, the relay charge 84 will be immediately ignited also and release hot gases through the primer flash tube seat 90 and into primer flash tube 54.

Diode D2 is electrically connected to the first electrically-conductive cylindrical sleeve 88 as part of the fuze-setting electromechanical circuit for carrying the electrical setting signal from the firing pin 65 and head assembly contact 67 via electrode 80, said first electrically-conductive cylindrical sleeve 88, diode D2, connector 89 and conductor 68 to fuze electronic circuit 76. Diode DI is electrically connected between the head assembly holder 53 and the second cylindrical sleeve 85 for carrying the electrical firing signal to the bridge wire 81 for activation of ignition charge 83

Figure 6F:
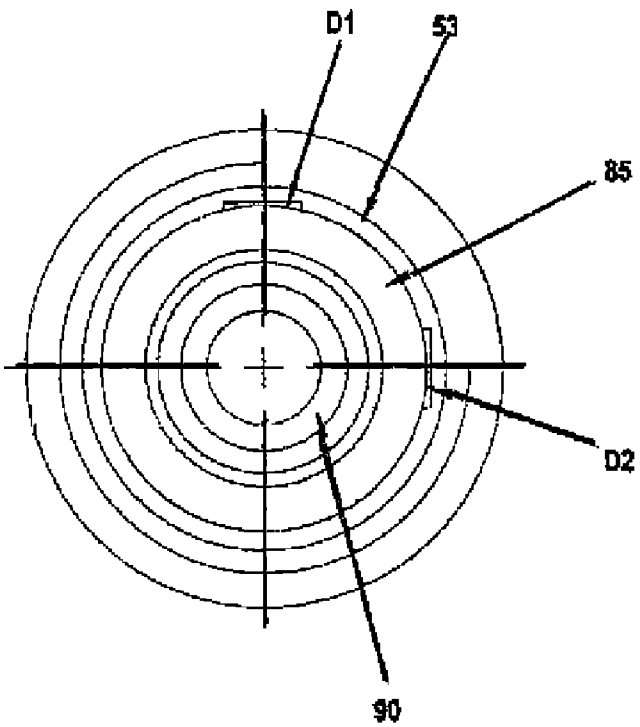
FIG. 6F is an end view of the head assembly contact (alternate placement).
Figure 6E:
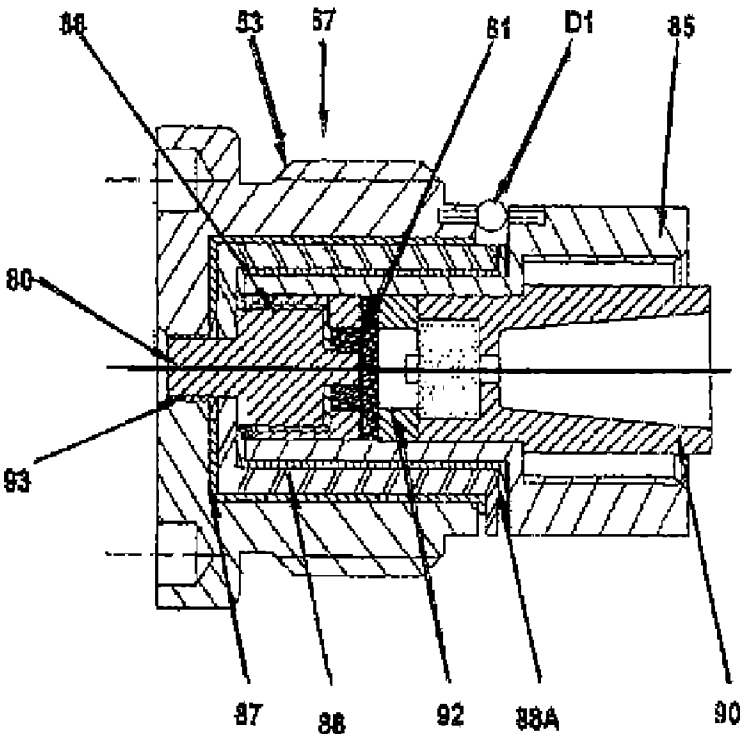
FIG. 6E is the same view as FIG. 6B but with an alternate diode placement.

In FIG. 6B diode DI is shown as being oriented longitudinally, parallel to the axis of the cartridge. In fact, the outer periphery of the second electrically conductive, cylindrical sleeve 85 may be shortened longitudinally and provided with a seat or cutout along its outer periphery and diode DI may be oriented to lie circumferentially along the outer surface of second electrically-conductive cylindrical sleeve 85. In such case, diode DI may be nested within the cutout (see FIGS. 6D, 6E and 6F)

In summary, FIGS. 6A, 6B and 6C illustrate how the head assembly contact 67 contains:

- head assembly holder 53;
- electrode 80, upon which firing pin 65 bears;
- insulation means 93;
- ignition cup 82 for containing bridge wire 81, ignition charge 83 and ignition cup insulation means 86;
- first electrically-conductive cylindrical sleeve 88;
- second electrically-conductive cylindrical sleeve 85;
- first sleeve insulation means 87 between head assembly holder 53 and first electrically-conductive cylindrical sleeve 88;
- second sleeve insulation means 88A between first electrically-conductive cylindrical sleeve 88 and second electrically-conductive cylindrical sleeve 85;
- connector 89 between diode D2 and conductor 68;
- retainer 92, and
- flash tube seat 90 containing relay charge 84.

Insulation means 86, 87, 88A and 93 may be made of either plastic, a non-conductive anodized aluminum coating or any other suitable insulating material for added strength. Once these components have been assembled, flash tube seat 90 is fitted within the second electrically-conductive cylindrical sleeve 85. Then the rearward end of flash tube 54 is also fitted into second electrically-conductive cylindrical sleeve 85.

Although connector 89 may be of any suitable design, the press-fit variety is preferred because of its easier installation. A press fit connector may also be used to effect the connection between diode DI and head assembly holder 53 and between diode D1 at the second electrically-conductive cylindrical sleeve 85.

As can be followed in FIG. 6A, the fuze-setting signal enters the cartridge 50 through electrode 80, passes through first electrically-conductive cylindrical sleeve 88 to diode D2 and then through connector 89 to conductor 68. Diode D2, which is connected to first cylindrical sleeve 88, is shown in FIG. 6A as overlying the second electrically-conductive cylindrical sleeve 85. Diode D2, however, could be located anywhere in the electromechanical circuit (e.g., anywhere along conductors 68 or 72, or embedded in fuze 63).

Firing signal current passes along a firing path that includes electrode 80, bridge wire 81, ignition cup sub-assembly 82, second electrically-conductive cylindrical sleeve 85, diode D1 and head assembly holder 53 (FIG. 6B).

Figure 7A:
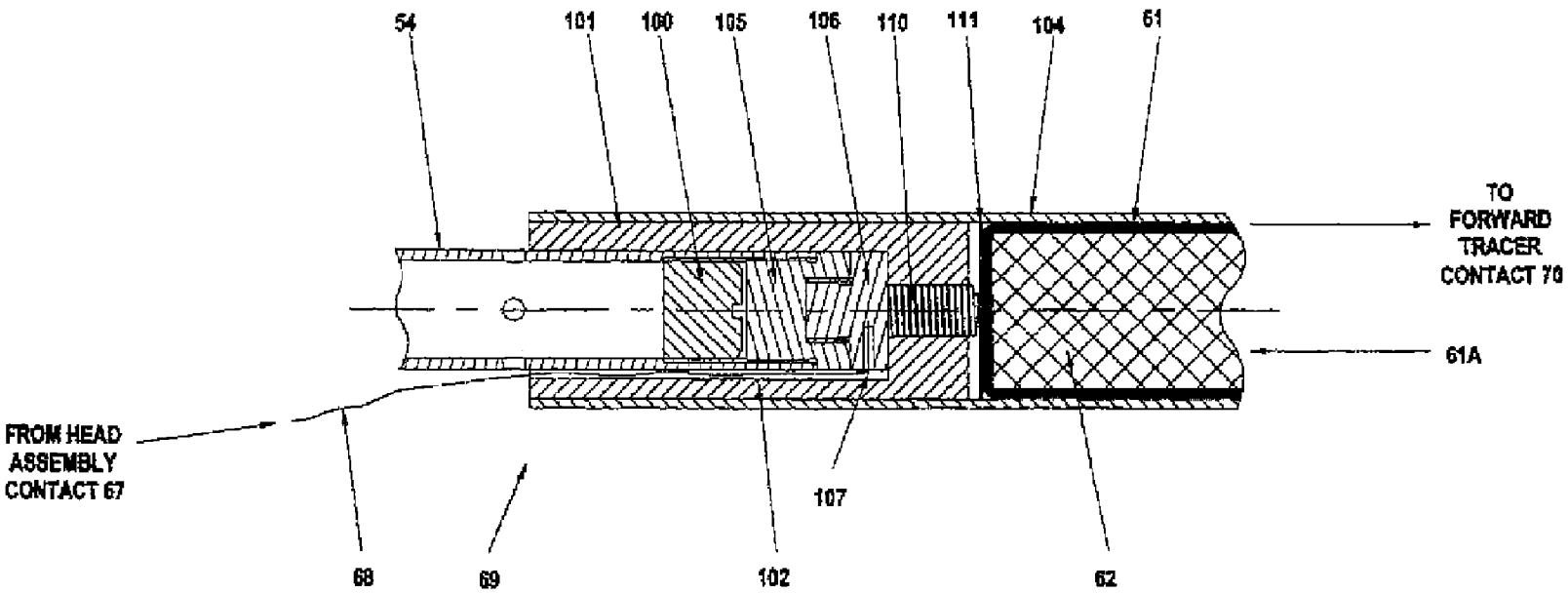
FIG. 7A is a cross-sectional side view of the rear tracer contact.

FIG. 7A illustrates rear tracer contact 69, which comprises primer flash tube 54, primer flash tube end closure 100, non-conducting forward end retainer 101 with longitudinal slot 102 containing conductor 68, non-conducting (e.g., cardboard) guide tube/funnel 104, non-conducting plug 105, electrically-conductive plug 106 with connector post 107, electrically-conductive spring-loaded connector 110, electrically-conductive disk 111, and tracer unit 61A with electrically-conductive tracer container 61 and tracer compound 62. The incoming setting signal from head assembly contact 67 is carried by conductor 68 and enters rear tracer contact 69 at connector post 107. Thereafter it travels through electrically-conductive plug 106, electrically-conductive spring-loaded connector 110, electrically-conductive disk 111, electrically-conductive tracer container 61 and onwards to forward tracer contact 70.

In FIG. 7A, the setting signal is insulated from metallic primer flash tube 54 and metallic primer flash tube end closure 100 by non-conductive forward end retainer 101 and non-conductive (typically plastic) plug 105. Electrically-conductive spring-loaded connector 110 is compressed to ensure a positive contact with electrically-conductive plug 106 at one end and with electrically-conductive disk 111 at the other end. The setting signal is constrained to pass through electrically-conductive spring-loaded connector 110 by non-conducting forward end retainer 101. Electrically-conductive disk 111 is included to prevent electrically-conductive spring-loaded connector 110 from damaging the thin end wall of electrically-conductive tracer container 61. The side wall of said tracer container 61 is much thicker in most instances.

Figure 7B:
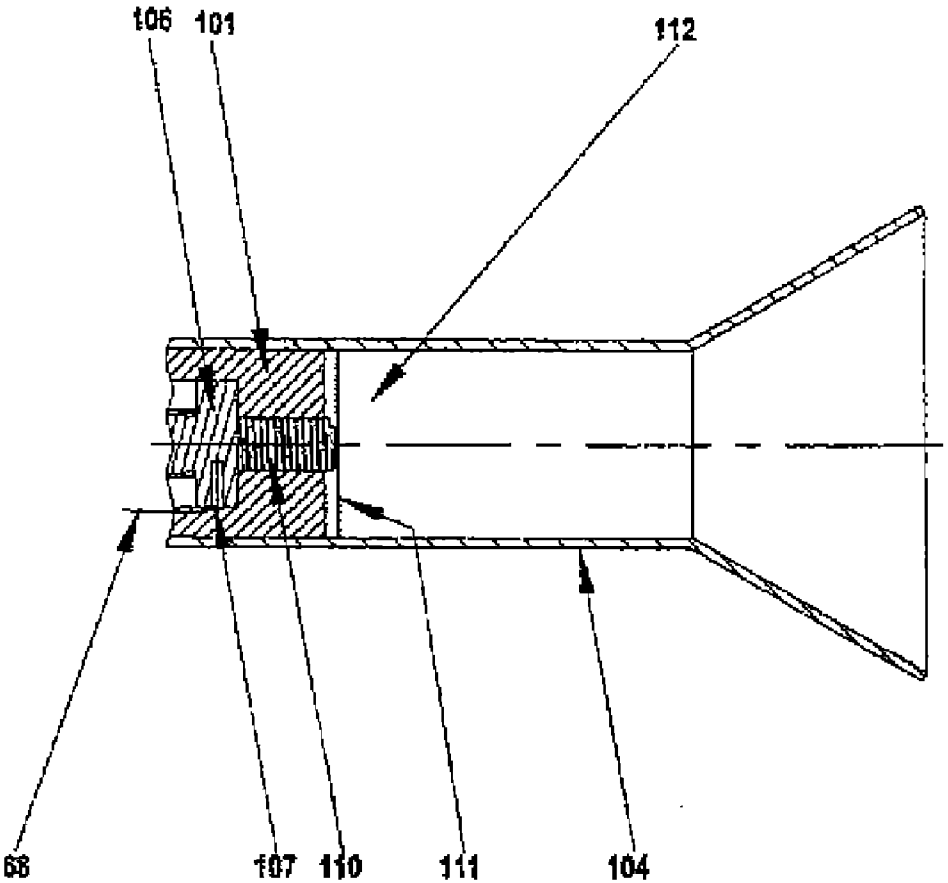
FIG. 7B is a cross-sectional side view of the electrically conductive seat for the rear tracer contact of FIG. 7A.

FIG. 7B illustrates, prior to insertion of tracer unit 61A, tracer seat 112, which is formed by non-conducting guide tube/funnel 104, and electrically-conductive disk 111 (adjacent to and in contact with electrically-conductive spring-loaded connector 110). As explained in more detail at FIG. 10 below, tracer unit 61A is inserted into tracer seat 112 during final assembly of cartridge 50.

Figure 8B:
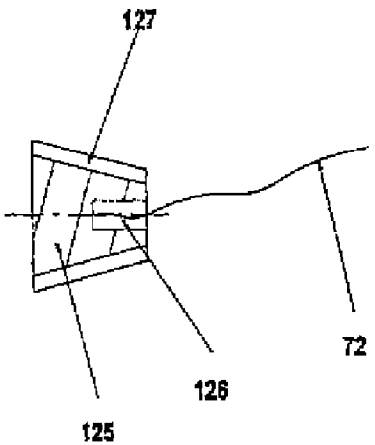
Figure 8A:
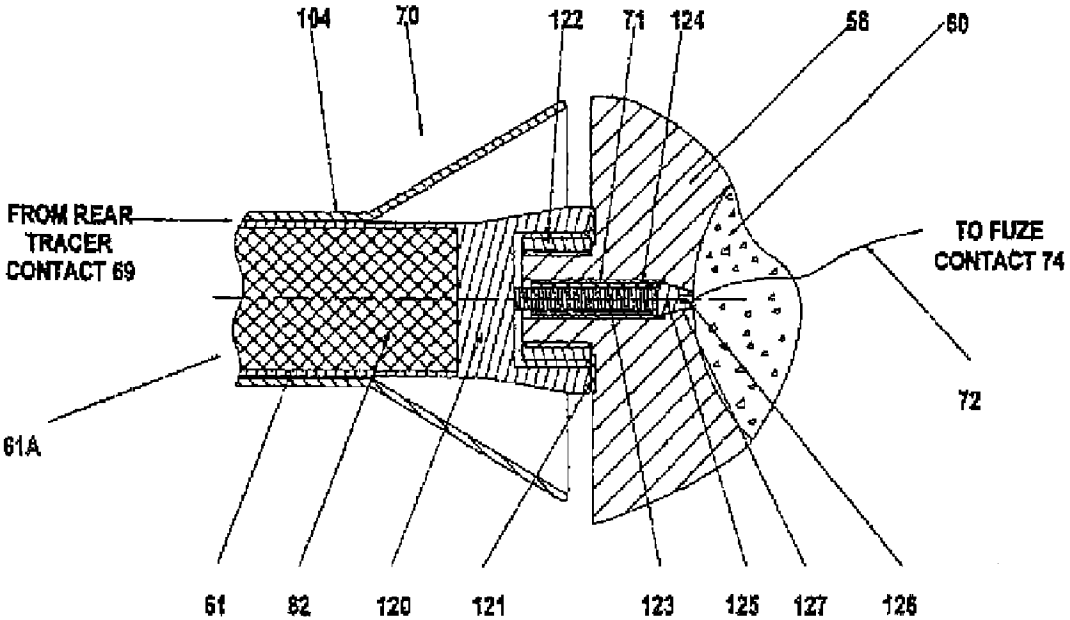

FIG. 8A illustrates forward tracer contact 70, which comprises tracer unit 61 A with electrically-conductive tracer container 61 containing tracer compound 62, tracer base 120, non-conducting guide tube/funnel 104, non-conducting high-pressure washer 121, non-conducting nut 122, electrically-conductive spring-loaded connector 123 located in conduit 71, threaded non-conducting sleeve 124, insulated electrically-conductive high-pressure seal 125, connector post 126, and conductor 72. Threaded non-conductive sleeve 124 holds electrically-conductive spring-loaded connector 123 within its hollow core and ensures that insulated electrically-conductive high-pressure seal 125 is firmly seated in place by being screwed into projectile base 58 of projectile 57. The insulation for electrically-conductive high-pressure seal 125 may be provided, for example, by a non-conductive conical outer surface 127.

High-pressure seal 125 is shown in FIG. 8B as being conical in shape, but it may also be spherical, cylindrical or any other suitable shape that responds to pressure on one side by ensuring the effectiveness of the seal with the sidewalls of the seating orifice formed in the base of the projectile. Although preferably made of metal, seal 125 may also be fabricated from any other suitable material that meets its design requirements (e.g., a ceramic or reinforced plastic material with provision to provide electrical conduction).

The incoming setting signal from rear tracer contact 69 travels along electrically-conductive tracer container 61 to electrically-conductive tracer base 120, 30 then through electrically-conductive spring-loaded connector 123 and high-pressure seal 125 to connector post 126 and conductor 72, which leads to fuze contact 74.

Electrically-conductive high-pressure seal 125 is illustrated in FIG. 8B in its preferred conical embodiment with its outer surface 127 insulated by, for example, anodizing of the aluminum from which it may be manufactured. Thus, the fuze setting signal in FIG. 8A is insulated from projectile base 58 of projectile 57 by non-conducting washer 121, non-conducting nut 122, threaded non-conductive sleeve 124 and the insulated outer surface 127 of high-pressure seal 125. Non-conductive high-pressure washer 121 and non-conductive. nut 122 may be made, for example, from. anodized aluminum; other materials that provide similar performance may also be used. These high-pressure seals are required to isolate high explosive 60 from the hot propellant gases produced by the burning of propellant 55 contained in cartridge case 51 after the firing of cartridge 50 (see FIG. 4). Non-conducting guide tube/funnel 104 (preferably cardboard or some other non-electrostatic material) plays no direct role in the electromechanical circuit described herein for the setting signal; rather, it is present to prevent crushing of propellant 55 when projectile 57 is inserted into cartridge case 51 during assembly of cartridge 50 as well as to guide tracer unit 61A into place (see FIG. 10).

Figure 8C:
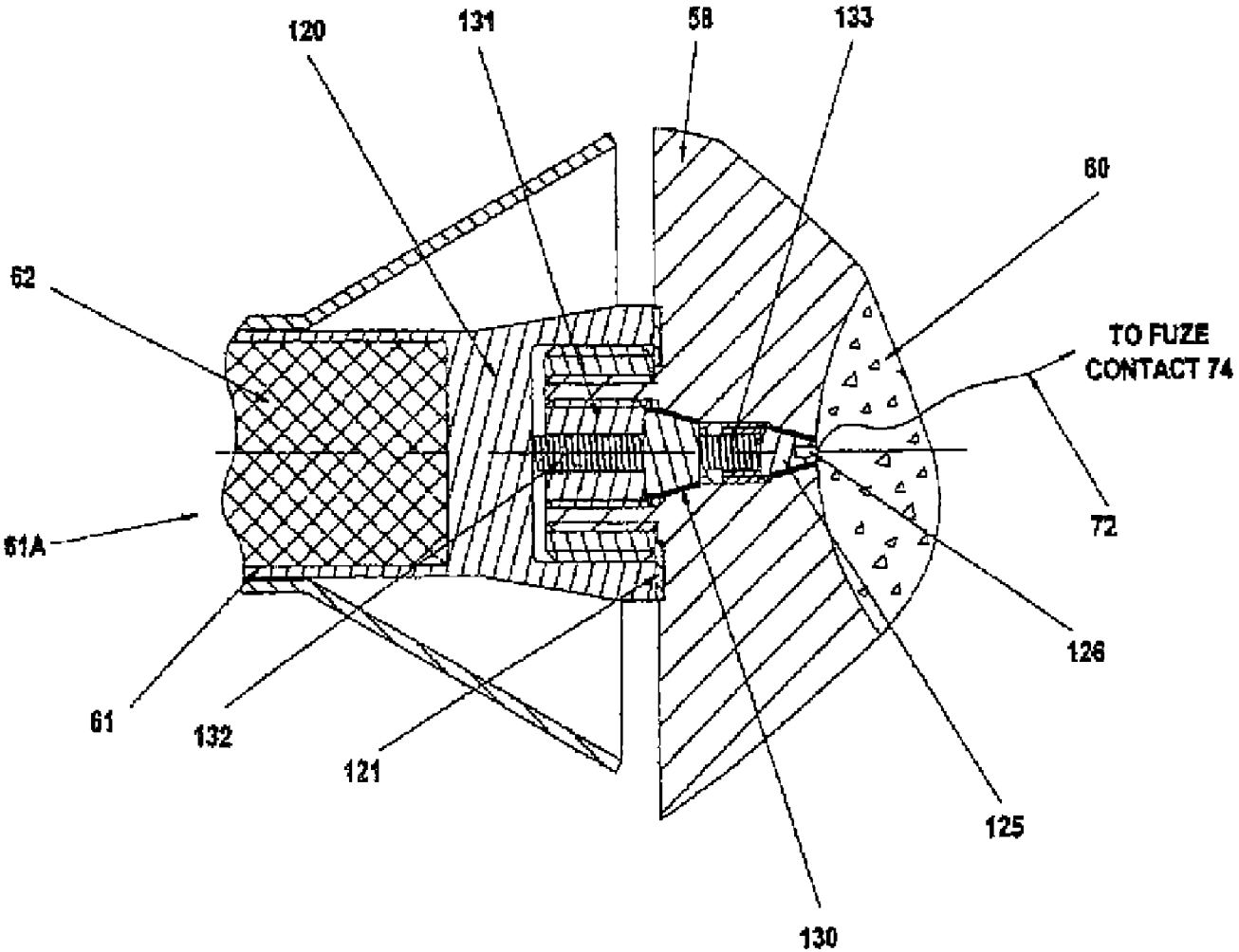

FIG. 8C is an alternative design to that shown in FIG. 8A. It adds insulated (as by a non-conductive coating) conical, electrically-conductive, high-pressure seal 130 as a backup to high-pressure seal 125 and high-pressure washer 121 to ensure against the possibility of hot propellant gases reaching high explosive 60 and causing premature detonation. In this configuration, threaded non-conducting tube 131 is added to hold insulated electrically-conductive high-pressure seal 130 in place. Thus, the setting signal passes through electrically-conductive spring-loaded connector 132, insulated electrically-conductive high-pressure seal 130, electrically-conductive spring-loaded connector 133 and insulated electrically-conductive high-pressure seal 125 to reach connector post 126 and conductor 72.

Figure 9A:
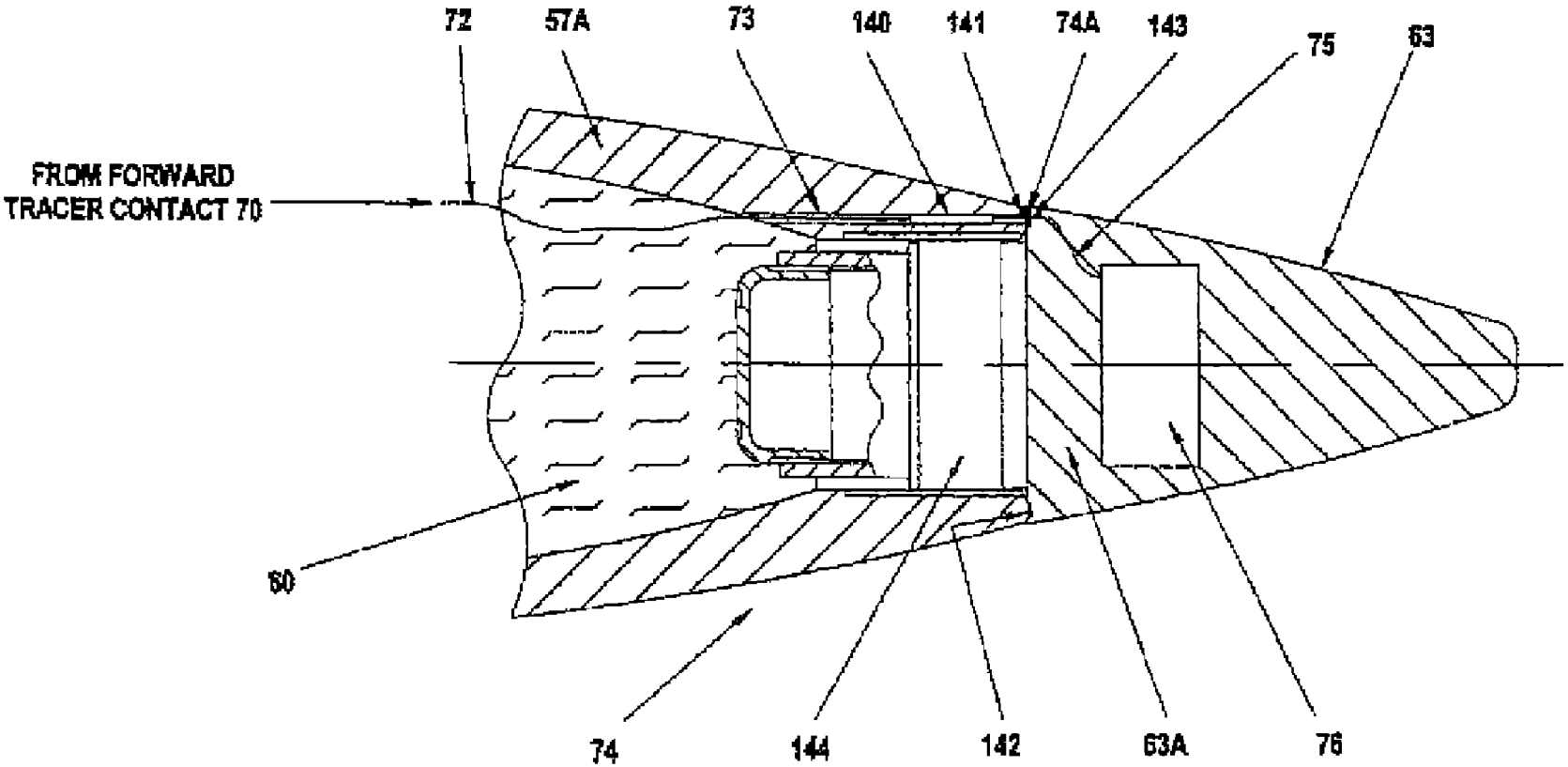
FIG. 9A is a cross-sectional side view of the fuze contact.
Figure 9C:
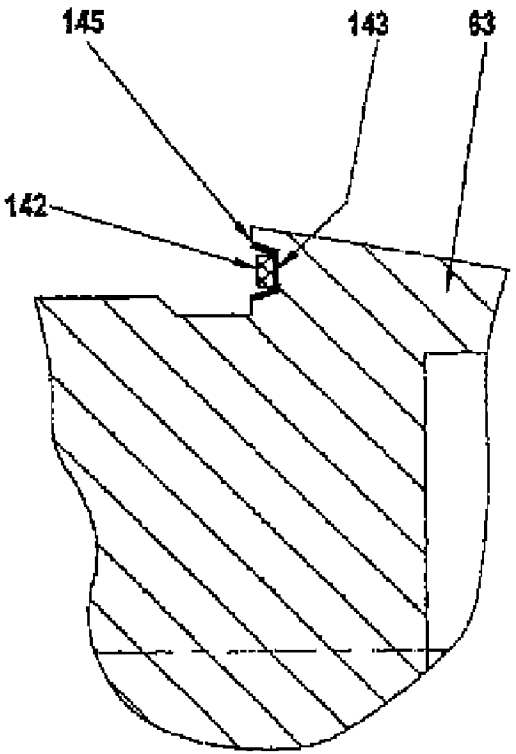
FIG. 9C is an enlarged, partial cross-section of the annular contact in the base of the fuze.
Figure 9B:
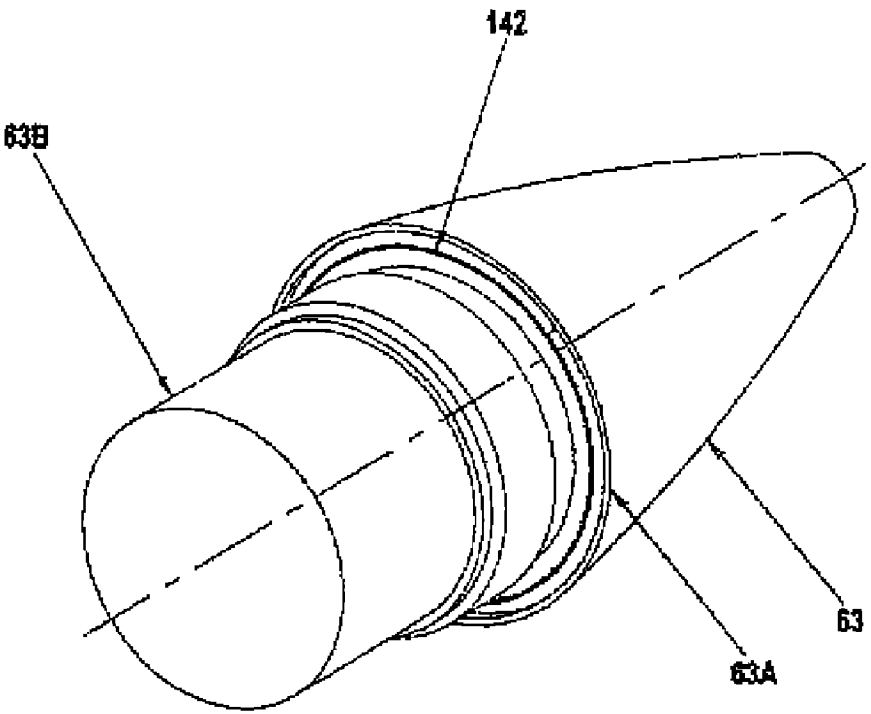
FIG. 9B is a 3-dimensional depiction of the fuze contact.

FIG. 9A illustrates fuze contact 74, which comprises conduit 73 through which conductor 72 passes to meet and join with electrically-conductive spring-loaded connector 140, which is also attached to connector post 141 at the forward end of projectile body 57A. Connector post 141 of projectile body 57A mates with annular ring conductor (or connector) 142 having a centre point and located in annular groove 143 on the fuze base 63A of programmable multifunctional electronic fuze 63 (FIG. 9B). Annular ring conductor 142 is insulated from fuze 63 by insulating circular insert 145, which is seated in annular groove 143 (FIG. 9C). Insulating circular insert 145 may be polymeric in nature, or any other suitable insulating material. Conductor 75 completes the electromechanical circuit linking fire control system 64 with fuze electronic circuit 76 of fuze 63.

Annular ring connector 142 consists of a gold (or other suitable conductive material) plated ring seated in insulating circular insert 145 fitted within full 360° circumference of annular groove 143, thereby ensuring a positive electrical connection at point of contact 74A regardless of the orientation of fuze 63 with respect to projectile body 57A when it is screwed into booster cavity 144 of projectile body 57A through a rotational coupling. Any rotational coupling having a central rotational axis aligned with the projectile and passing through the centre point of annular ring conductor 142 can be used to attach the fuze 63 to the projectile.

The described embodiment has connector post 141 on projectile body 57A and the annular connector 142 on fuze 63. Alternately, annular connector 142 and connector post 141 with electrically-conductive spring-loaded connector 140 may be reversed with the former electrically-conductive by projectile body 57A and the latter carried by fuze 63.

Figure 10:
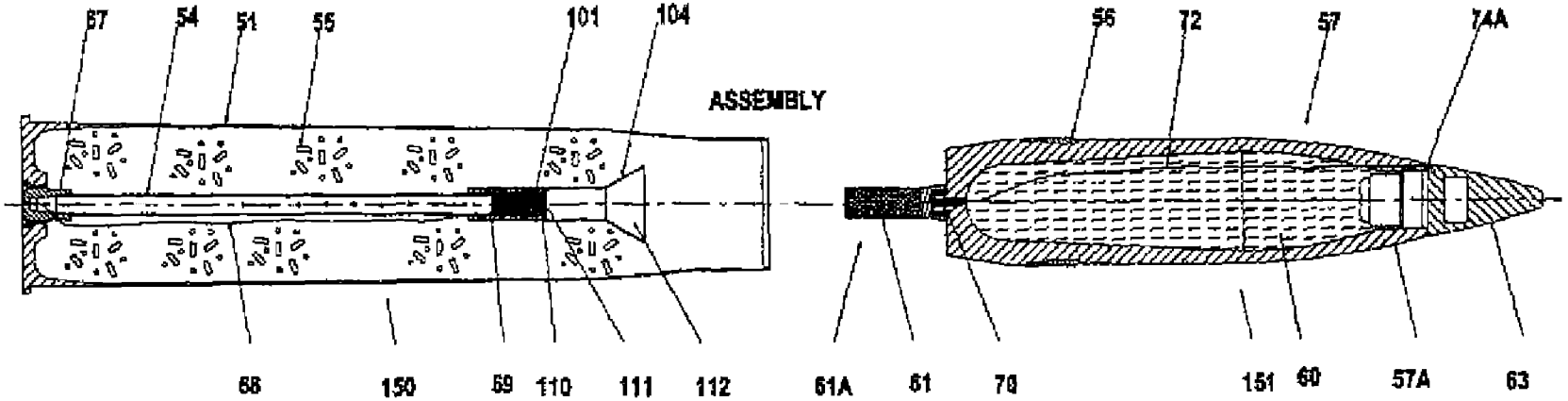
FIG. 10 is a cross-section of the case preassembly and the projectile preassembly just prior to final cartridge assembly.

FIG. 10 illustrates the final cartridge assembly procedure. Case preassembly 150, comprises principally cartridge case 51 loaded with propellant 55, primer flash tube 54, head assembly contact 67, conductor 68, rear tracer contact 69 with spring loaded connector 110, and non-conducting guide tube/funnel 104. Projectile preassembly 151 comprises principally projectile 57 with projectile body 57A loaded with high explosive 60, forward tracer contact 70, conductor 72, point of contact 74A, fuze 63, and tracer unit 61A with electrically-conductive tracer container 61. When projectile preassembly 151 is lowered into case preassembly 150, tracer unit 61A is guided into position by non-conducting guide tube/funnel 104 until contact is made between the end of tracer container 61 of projectile preassembly 151 and spring-loaded connector 110 of case preassembly 150. The case/projectile interface for the fuze setting circuit is ensured by a positive compression of spring-loaded connector 110 by electrically-conductive tracer container 61, thereby connecting the two parts of the fuze setting-signal circuit contained respectively in case preassembly 150 and projectile preassembly 151. This "plug-in" operation provides simultaneous mechanical and electrical coupling at the case/projectile interface and, by its very simplicity, is an important contributor to both safety and reliability.

The use of the electrically-conductive tracer container 61 as part of the fuze-setting circuit allows the projectile to be mounted mechanically on the cartridge case 51 without any extra steps being necessary to effect an electrical connection. This is important because, when these components are mated, the cartridge case 51 is filled with propellant 55 and the projectile contains high explosive 60. In such conditions, assembly should be as simple as possible. For similar reasons, the fuze 63 portion, upon assembly, also effects simultaneous mechanical and electrical connections to the projectile when it is screwed into place.

In tests the electromechanical circuit described herein has demonstrated that it contributes appreciably to economical manufacturing techniques while yielding highly reliable and safe transmission of signals from the fire control system to the programmable fuze in a 105 mm gun such as in the Leopard tank.

As referenced previously, although the invention is described in respect to setting a fuze, the invention could also be used to activate a trigger for programming a camera, activating a chemical sensor, turning-on a target designator-illuminator or actuating other similar types of payload. Accordingly, when reference is made to "fuze" in the disclosure and in the claims, this word is intended to include any sort of payload electronic device. And similarly, the explosive is described as simply an example of a payload. Accordingly, when a reference is made to "explosive" in the disclosure and in the claims, this word is intended to include any sort of payload.

The features of the invention as described therefore successfully address the object of a rendering assembly of the final shell as simple as possible

CONCLUSION

The foregoing constitutes a description of specific embodiments showing how the invention may be applied and put into use. These embodiments are only exemplary. The invention in its broadest and more specific aspects is further described and defined in the claims which now follow.

These claims, and the language used therein, are to be understood in terms of the variants of the invention which has been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. In a cartridge comprising a case with a head assembly and a load carrying projectile fitted to said case, said projectile having programmable electronics mounted therein at its forward end, an electromechanical electronics-setting circuit present within said cartridge for transmitting an electrical setting signal originating from an external fire control system through the head assembly to said programmable electronics, wherein said projectile has a base with a conduit penetrating there-through that communicates with the payload-containing interior of the projectile through a high-pressure seat, and wherein a portion of said electromechanical circuit comprises a conductive, spring-loaded high-pressure sealing connector insulated from said case and slidingly seated at least partially within said high-pressure seat to effect a high-pressure seal of said conduit and prevent hot propellant gases arising upon firing of the cartridge from reaching the payload contained in the projectile while maintaining an electrically conductive path into the interior of the projectile that is insulated from said case; and with said electromechanical circuit having a path originating from said external firing control system, to an electrode present in said head assembly, to a first conductor, to an electrically conductive cylindrical container positioned at the rear of said projectile, to said spring-loaded high-pressure sealing connector, to a second conductor, to a fuze contact within said projectile, to a third conductor, to said programmable electronics, returning via a surface of said cartridge to ground.

2. The circuit of claim 1, wherein the cylindrical container further comprising a tracer unit.

3. The circuit of claim 1, wherein said conductive, spring-loaded high-pressure sealing connector comprises an electrically-conductive spring loaded connector and an insulated electrically-conductive high-pressure seal, with the insulated electrically-conductive high-pressure seal placed between the electrically-conductive spring loaded connector and the payload.

4. The circuit of claim 3, wherein the insulated electrically-conductive high-pressure seal is conical, spherical, cylindrical or other suitable shape.

5. The circuit of claim 1, wherein said conductive, spring-loaded high-pressure sealing connector comprises a first and second electrically-conductive spring loaded connector; and a first and second insulated electrically-conductive high-pressure seal, such that the electromechanical circuit path includes a segment from the first conductor, to the first spring-loaded high-pressure connector, to the first insulated electrically-conductive high-pressure seal, to the second spring-loaded high-pressure connector, to the second insulated electrically-conductive high-pressure seal, and to the second conductor.

6. The circuit of claim 5, wherein the first and second insulated electrically-conductive high-pressure seals are each conical, spherical, cylindrical or other suitable shape.

7. The circuit of claim 1, wherein the cylindrical container further comprising a base burner.

8. The circuit of claim 1, wherein the cylindrical container further comprising a rocket motor system.

* * * * *